US005884008A

United States Patent [19]

Goldberg

[11] Patent Number: 5,884,008

[45] Date of Patent: Mar. 16, 1999

[54] PORTABLE HAIR DRYER FOR USE IN A VEHICLE WITH HANDLE SWITCH RESPONSIVE TO PIVOTING AND VEHICLE BATTERY VOLTAGE INDICATOR

[76] Inventor: Sherry P Goldberg, 380 W. Valley Stream Blvd., Valley Stream, N.Y. 11580

[21] Appl. No.: 986,820

[22] Filed: Dec. 8, 1997

[51] Int. Cl.[6] ..... A45D 20/10

[52] U.S. Cl. ..... 392/385; 219/506; 219/202; 320/DIG. 21; 439/668; 206/320

[58] Field of Search ..... 392/383–385, 392/373, 374; 34/96–101, 90, 91; 219/202, 386, 387, 506; 116/28 R; 320/DIG. 21, DIG. 18, 136; 132/286, 313, 312, 315, 316; 307/10.7, 10.1; 439/668–669, 635, 34; 206/320

[56] References Cited

U.S. PATENT DOCUMENTS

| | | | |
|---|---|---|---|
| 1,752,948 | 4/1930 | Herrmann | 132/312 |
| 3,209,127 | 9/1965 | Graves | 392/385 |
| 3,211,890 | 10/1965 | Graves | 392/385 |
| 3,386,184 | 6/1968 | Ponczek | 34/97 |
| 3,932,797 | 1/1976 | York | 320/DIG. 21 |
| 3,967,133 | 6/1976 | Bokern | 307/10.1 |
| 3,986,272 | 10/1976 | Feierabent | 392/385 |
| 4,054,352 | 10/1977 | Rudin | 439/304 |
| 4,198,557 | 4/1980 | Crowley | 392/384 |
| 4,248,494 | 2/1981 | McDonald et al. | 439/638 |
| 4,366,363 | 12/1982 | Stephens, III | 392/385 |
| 4,555,232 | 11/1985 | Raccah et al. | 34/97 |
| 4,556,782 | 12/1985 | Fujishima et al. | 392/384 |
| 4,874,921 | 10/1989 | Gerbig, jr. | 219/202 |
| 4,939,345 | 7/1990 | Farina et al. | 392/384 |
| 5,007,863 | 4/1991 | Rudin | 439/639 |
| 5,326,283 | 7/1994 | Chen | 439/638 |
| 5,345,163 | 9/1994 | Gibbons et al. | 320/48 |
| 5,394,620 | 3/1995 | Chimera | 34/97 |
| 5,463,203 | 10/1995 | Moore | 219/202 |
| 5,519,383 | 5/1996 | De La Rosa | 340/636 |
| 5,521,443 | 5/1996 | Imura et al. | 307/10.7 |

FOREIGN PATENT DOCUMENTS

| | | | |
|---|---|---|---|
| 2927887 | 1/1981 | Germany . | |
| 29706913 | 6/1997 | Germany | 392/384 |
| 2167089 | 5/1986 | United Kingdom . | |
| 2295006 | 5/1996 | United Kingdom . | |

*Primary Examiner*—John A. Jeffery
*Attorney, Agent, or Firm*—Michael I. Kroll

[57] ABSTRACT

A portable hair dryer (12) comprising a tubular housing (14) having an air inlet end (16) and an air outlet nozzle end (18). A foldable hollow pistol-type handle (20) is pivotally connected at pivot pin (22) to the tubular housing (14) adjacent the air inlet end (16). The handle (20) can pivot from an inoperative position parallel to the tubular housing (14) to an operative position perpendicular to the tubular housing (14). An electrically actuated air pump assembly (24) is in the tubular housing (14) to draw air in through the air inlet end (16) and out through the air outlet nozzle end (18). An electrical resistance heating element (26) is disposed within the tubular housing (14) between the air pump assembly (24) and the air outlet nozzle end (18), to heat the air passing through the tubular housing (14). A circuit (28) electrically connects the air pump assembly (24) and the heating element (26) with a source of electrical power through the handle (20). A handle positioning switch (30) is in the circuit (28) between the tubular housing (14) and the handle (20). When the handle (20) pivots from the inoperative position to the operative position, the handle positioning switch (30) will electrically close the circuit (28).

7 Claims, 4 Drawing Sheets

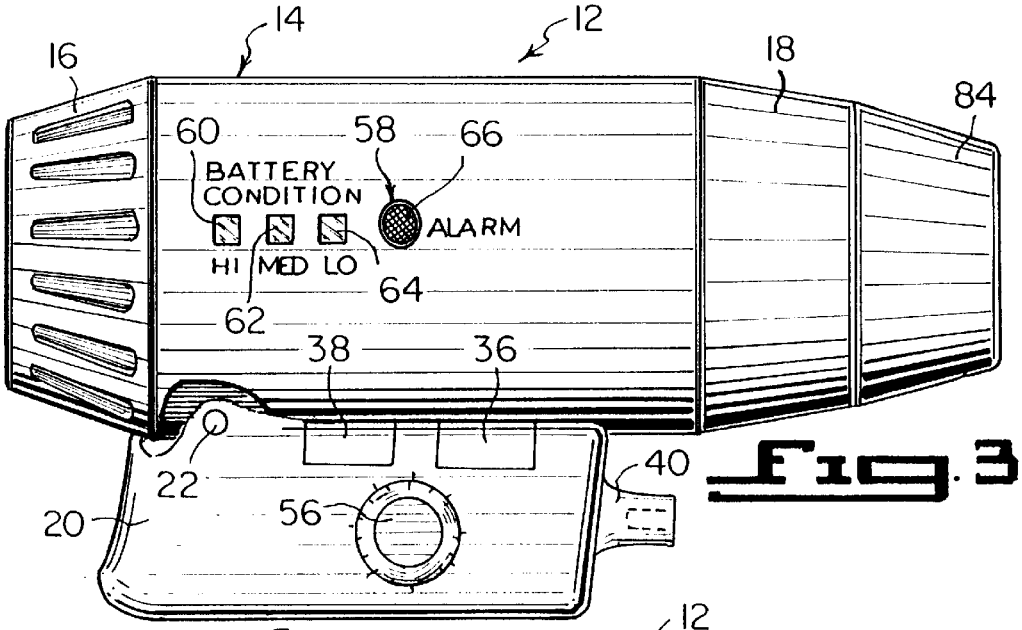
Fig. 3
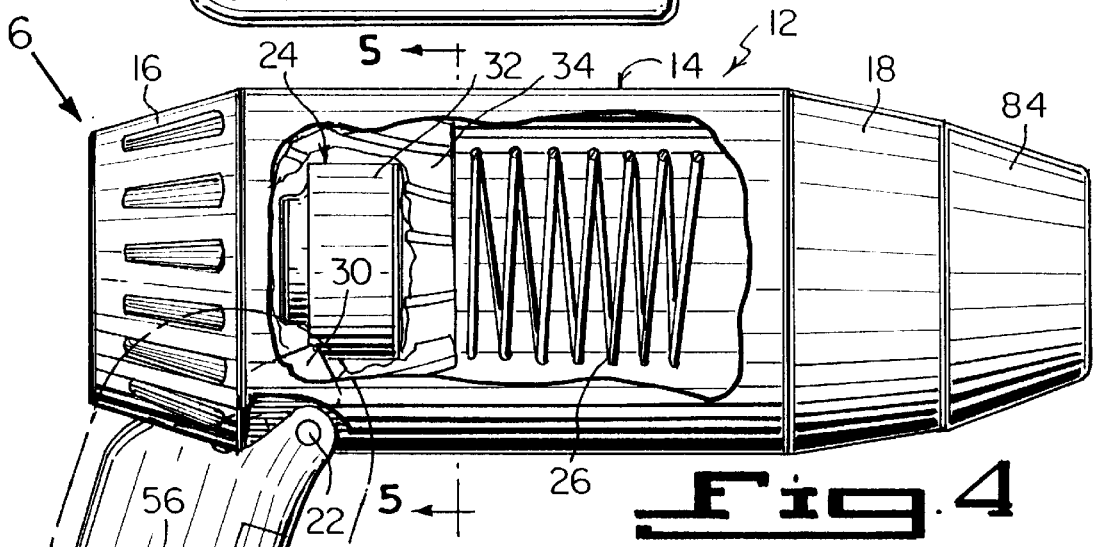
Fig. 4
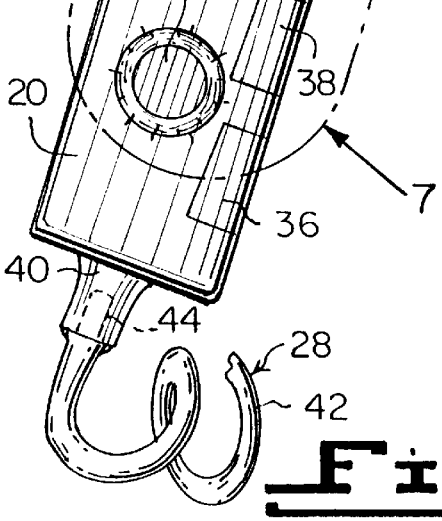
Fig. 5
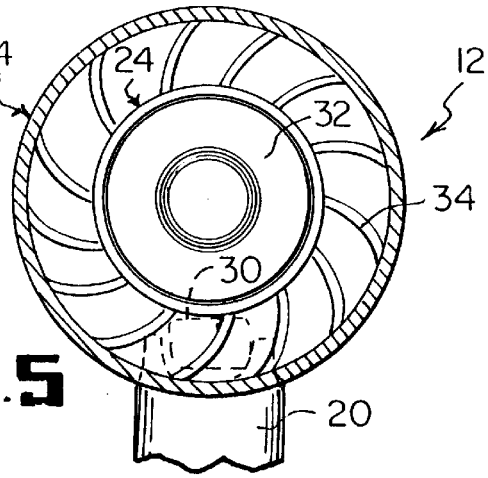

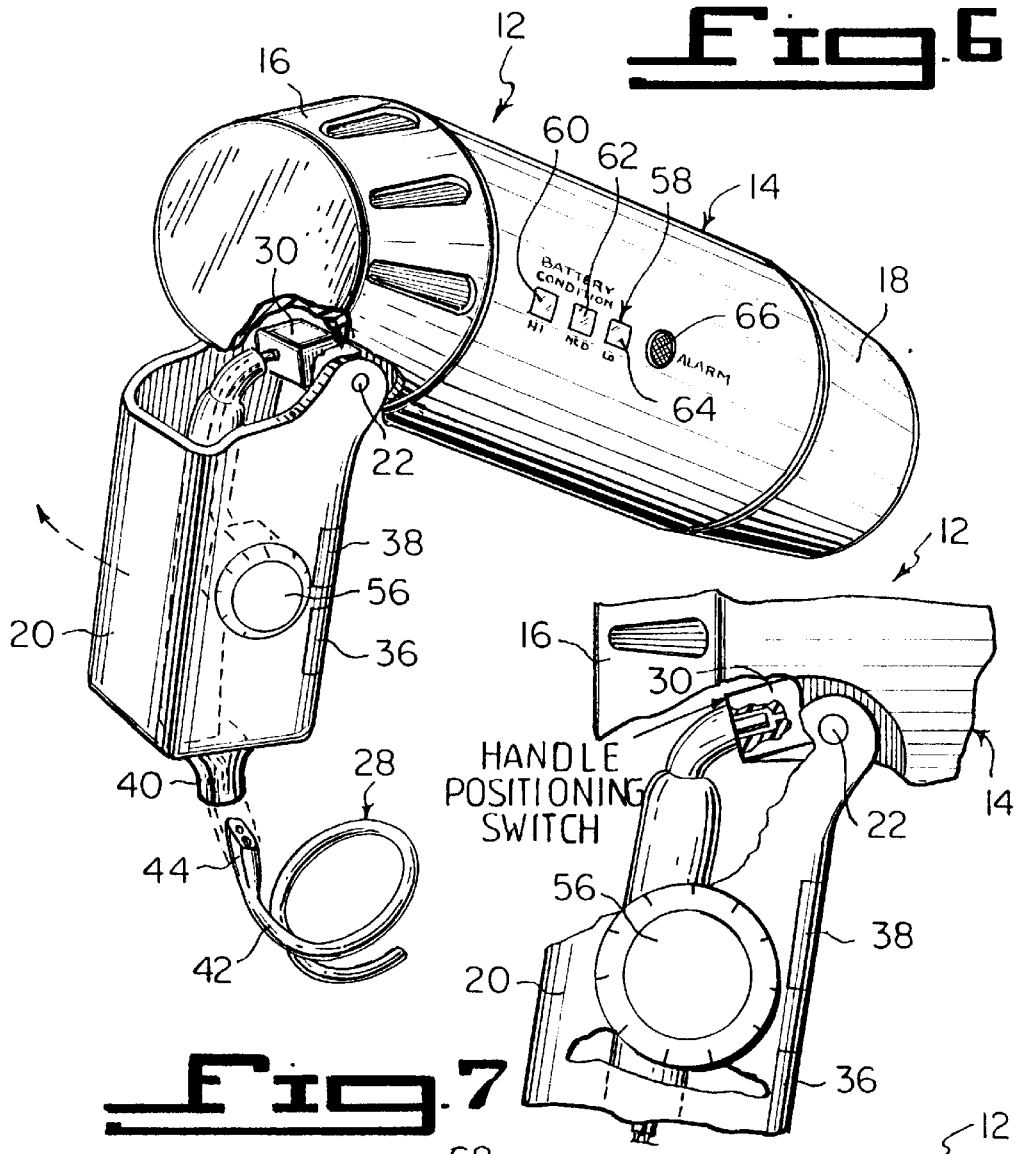
Fig. 6
Fig. 7
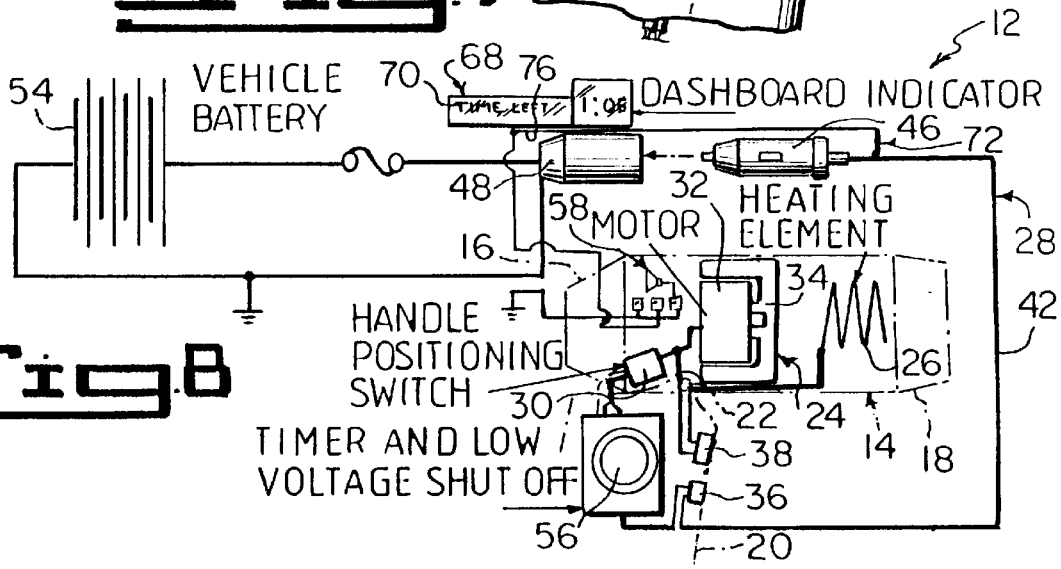
Fig. 8

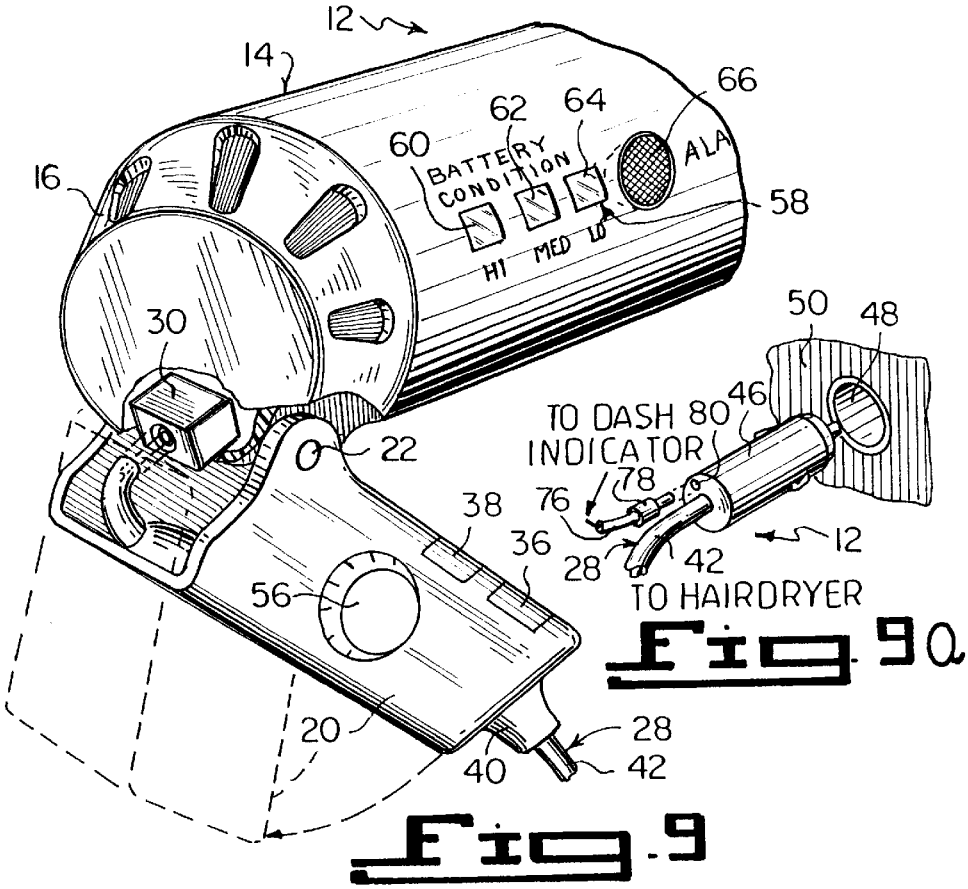
Fig. 9a
Fig. 9
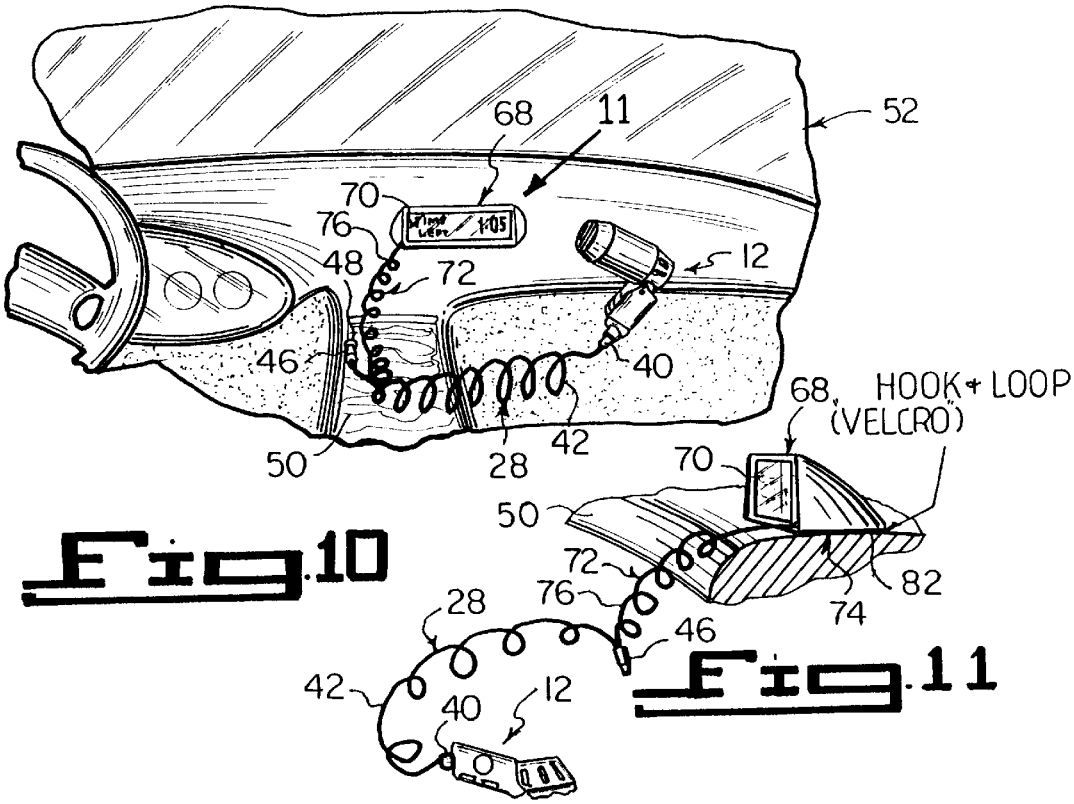
Fig. 10
Fig. 11

PORTABLE HAIR DRYER FOR USE IN A VEHICLE WITH HANDLE SWITCH RESPONSIVE TO PIVOTING AND VEHICLE BATTERY VOLTAGE INDICATOR

BACKGROUND OF THE INVENTION

1. Field of the Invention

The instant invention relates generally to portable heated air blower devices and power supply sources, and more specifically it relates to a portable hair dryer. The portable hair dryer has a power cord with a male adapter plug that plugs into a cigarette lighter receptacle in a dashboard in a motor vehicle, so that electricity from the battery can operate it. The handle can fold up against the cylindrical housing, so that it can conveniently fit into a carry case.

2. Description of the Prior Art

Numerous portable heated blower devices and power supply sources have been provided in prior art. For example, U.S. Pat. Nos. 3,967,133 to Bokern; 4,366,368 to Stephens, III; 4,555,232 to Raccah et al. and 4,939,345 to Farina et al. all are illustrative of such prior art. While these units may be suitable for the particular purpose to which they address, they would not be as suitable for the purposes of the present invention as heretofore described.

BOKERN, JAMES F.

POWER SUPPLY MEANS

U.S. Pat. No. 3,967,133

A power source particularly for use in remote locations which can be operated off of conventional sources of power such as off a battery source. The power source includes means for distinguishing between different voltages and means to indicate when power has been reduced from the power source or battery below a safe level for taking additional power therefrom. The device also includes means for preventing a polarity reversal from causing damage and adapter means by which the subject power source can be plugged into a conventional receptacle such as into a cigarette lighter receptacle on the dashboard of an automobile or similar device. The subject device is particularly suitable for use by campers, emergency crews, and others who need power at remote locations and from a conventional source of power such as from a vehicle battery.

STEPHENS, III, WILLIAM S.

ELECTRIC HEATER-BLOWER APPARATUS FOR REMOVING FROST AND SNOW FROM VEHICLE WINDOWS

U.S. Pat. No. 4,366,368

A portable frost and snow removing appliance for use in removing ice and snow from the surfaces of vehicle windows includes an elongated housing having a pistol handgrip at one end. An electrically operated two-speed blower and a resistance heater are arranged to produce a high speed jet of unheated air or a slower stream of heated air through a discharge nozzle shiftably mounted on the other end of the housing and movable between first and second positions. The housing includes a lateral air outlet in a side wall between the heater and nozzle. The nozzle includes as a unitary one-piece structure therewith, valve members within the housing and nozzle and cooperatively associated with the housing other end and the lateral air outlet to inversely open and close the lateral outlet and housing other end in response to shifting of the nozzle to its first and second positions, respectively, to permit air to be selectively discharged from either the nozzle or lateral air outlet. The housing is capable of being placed on its side upon the upper surface of a vehicle dash and operated in a manner to discharge heated air through the lateral air outlet upwardly along the inner windshield surface.

RACCAH, EDWARD R.

KING, JAMES B.

HAIR DRYING APPARATUS

U.S. Pat. No. 4,555,232

A portable hair drying apparatus has a tubular body with an air inlet at one end also containing an electric motor driving impeller and powered by rechargeable cells. The air flows over a gas burner assembly fed with gas from a liquid gas container via valve means. The container may be recharged through valve or detached at a coupling joint and replaced. The gas burner may comprise a tube surrounded by a catalyst impregnated fiber forming a flameless catalytic gas burner. The gas burner may be separated from direct contact with the air flow by means of a heat pump, one end of which is heated by the burner with the other end being located in the air flow.

FARINA, MICHELLE

FRONTARIO, JO-ANN

PORTABLE HAIR DRYER ASSEMBLY

U.S. Pat. No. 4,939,345

A portable hair dryer assembly includes a battery that is recharged to operate the air moving system of the assembly. The assembly further includes a cover for the air intake system, and a system for moving the air exhaust nozzle so that the assembly has a plurality of degrees of freedom. None of the references described above shows a portable hair dryer operating in a vehicle having a collapsible handle with a cutoff switch and a cigarette lighter male adapter plug with an auxiliary plug-in for powering a simultaneous display on the dashboard of the vehicle for indicating low battery voltage and which is a substantial duplicate of a display on the side of the hair dryer.

SUMMARY OF THE INVENTION

A primary object of the present invention is to provide a portable hair dryer that will overcome the shortcomings of the prior art devices.

Another object is to provide a portable hair dryer having a power cord with a male adapter plug that plugs into a cigarette lighter receptacle in a dashboard in a motor vehicle, so that electricity from the battery can operate it.

An additional object is to provide a portable hair dryer in which the handle can fold up against the cylindrical housing, so that it can conveniently fit into a carry case.

A further object is to provide a portable hair dryer that is simple and easy to use.

A still further object is to provide a portable hair dryer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 3 is a side view taken in the direction of arrow 3 in FIG. 2, with the power cord and male plug removed and the foldable handle in a closed position.

FIG. 4 is a side view similar to FIG. 3, with parts broken away and in section, the foldable handle in an opened position and a portion of the power cord connected in place.

FIG. 5 is a cross sectional view taken along line 5—5 in FIG. 4.

FIG. 6 is a perspective view taken in the direction of arrow 6 in FIG. 4, with parts broken away and the portion of the power cord ready to be connected in place.

FIG. 7 is an enlarged side view of an area in FIG. 4 as indicated by arrow 7, with parts broken away and in section.

FIG. 8 is a schematic diagram of the electrical circuit thereof.

FIG. 9 is a perspective view similar to FIG. 6, showing the pivoting feature of the foldable handle.

Figure 1:
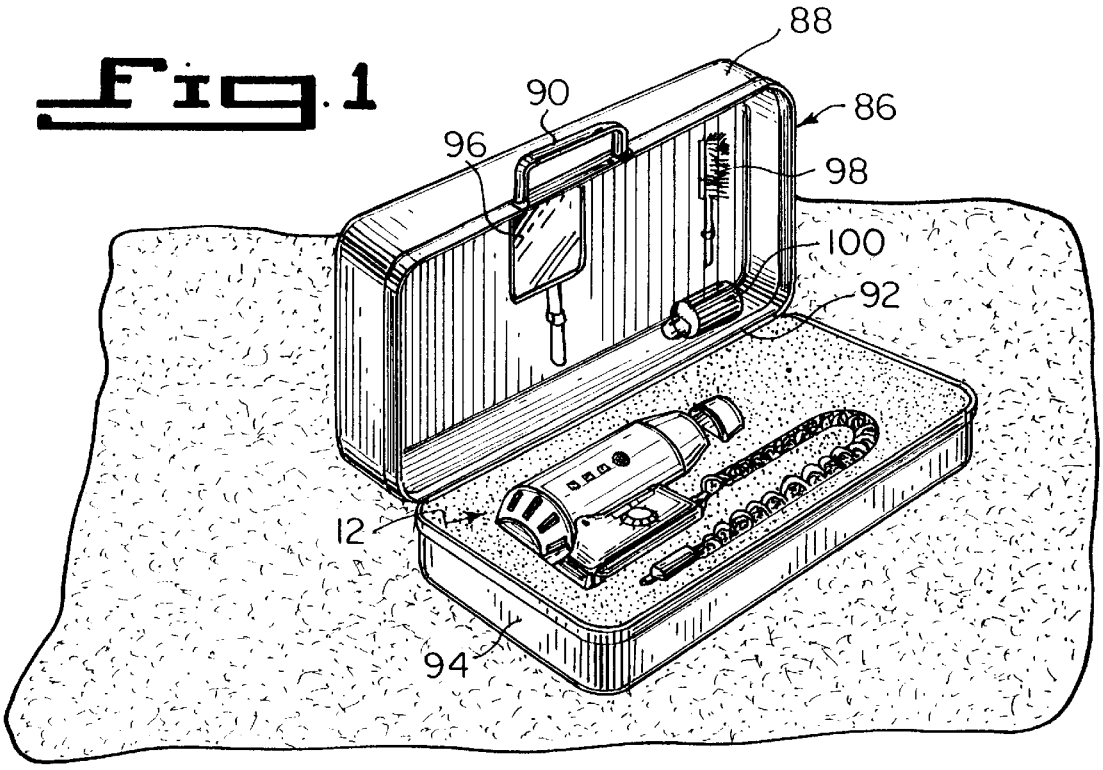
FIG. 1 is a perspective view of the present invention placed within an opened carry case.

FIG. 9*a* is an exploded perspective view, showing a modified male plug with a built-in socket to accommodate a jack on an auxiliary cord of a dashboard indicator, ready to go into the cigarette lighter receptacle in the dashboard.

FIG. 10 is a front perspective view of a portion of a dashboard in a motor vehicle, showing the modified male plug in the cigarette lighter receptacle electrically connected to the present invention and the dashboard indicator.

FIG. 11 is a side perspective view taken in the direction of arrow 11 in FIG. 10, showing a hook and loop VELCRO fastener to hold the dashboard indicator on the dashboard and the modified male plug disconnected from the cigarette lighter receptacle.

Similar reference characters denote corresponding features consistently throughout the attached drawings.

DETAILED DESCRIPTION OF THE PREFERRED EMBODIMENTS

Figure 2:
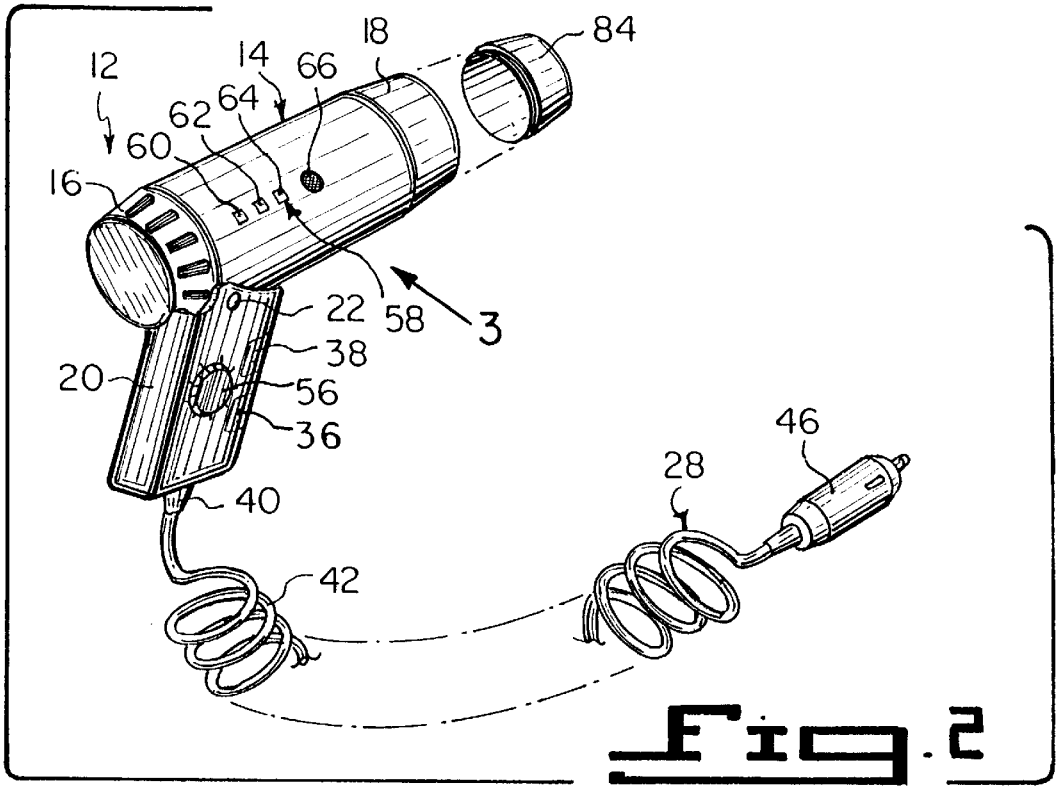
FIG. 2 is a perspective view of the present invention per se, with the nozzle adapter exploded therefrom.

Turning now descriptively to the drawings, in which similar reference characters denote similar elements throughout the several views, FIGS. 1 through 11 illustrate the present invention being a portable hair dryer 12.

The portable hair dryer 12 comprises a tubular housing 14 having an air inlet end 16 and an air outlet nozzle end 18. A foldable hollow pistol-type handle 20 is pivotally connected at pivot pin 22 to the tubular housing 14 adjacent the air inlet end 16. The handle 20 can pivot from an inoperative position parallel to the tubular housing 14 to an operative position perpendicular to the tubular housing 14. An electrically actuated air pump assembly 24 is in the tubular housing 14, to draw air in through the air inlet end 16 and out through the air outlet nozzle end 18.

An electrical resistance heating element 26 is disposed within the tubular housing 14 between the air pump assembly 24 and the air outlet nozzle end 18, to heat the air passing through the tubular housing 14. A circuit 28 electrically connects the air pump assembly 24 and the heating element 26 with a source of electrical power through the handle 20. A handle positioning switch 30 is in the circuit 28 between the tubular housing 14 and the handle 20. When the handle 20 pivots from the inoperative position to the operative position, the handle positioning switch 30 will electrically close the circuit 28.

The air pump assembly 24 includes a two-speed (low and high) electric motor 32. An air impeller 34 is driven by the motor 32. A three position switch 36 is in the circuit 28 disposed on the handle 20 and electrically connected to the motor 32 to selectively actuate the motor 32 at low speed, high speed and in an off position. A three position heat control switch 38 in the circuit 28 is disposed on the handle 20 and electrically connected to the heating element 26, to selectively control heat to the heating element 26 at hot, warm and cool positions.

The circuit 28 consists of a male connector 40 on distal free end of the handle 20. A power cord 42 has a female connector 44 on a first end to be inserted into the male connector 40. A male adapter plug 46 is on a second end of the power cord 42, to engage with a cigarette lighter receptacle 48 in a dashboard 50 of a motor vehicle 52 that is electrically connected to a battery 54 in the motor vehicle 52, which is the source of electrical power.

A timer and low voltage shut off member 56 in the circuit 28 is disposed on the handle 20, so as to time complete operation thereof. A facility 58 is disposed in the tubular housing 14 and electrically connected in the circuit 28 to the male adapter plug 46 is for indicating various voltage conditions of the battery 54 in the motor vehicle 52.

The indicating facility 58 comprises a first diode sensor 60, to visually indicate a high voltage condition of the battery 54. A second diode sensor 62 visually indicates a medium voltage condition of the battery 54. A third diode sensor 64 visually indicates a low voltage condition of the battery 54. An alarm 66 is electrically connected to the third diode sensor 64. When the third diode sensor 64 is activated, the alarm 66 will sound to audibly indicate the low voltage condition of the battery 54.

The portable hair dryer 12 further includes a dashboard indicator 68 having a digital display 70. An assemblage 72 is for electrically connecting the dashboard indicator 68 to the male adapter plug 46, so that the digital display 70 will indicate the amount of voltage life left in the battery 54. A structure 74 is for attaching the dashboard indicator 68 in a removable manner to the dashboard 50 in the motor vehicle 52.

The electrically connecting assemblage 72 consists of an auxiliary power cord 76 having a first end electrically connected to the dashboard indicator 68. A jack 78 is electrically connected to a second end of the auxiliary power cord 76. The male adapter plug 46 has a socket 80 to receive the jack 78. The dashboard attaching structure 74 is a hook and loop VELCRO fastener 82 secured between a bottom surface of the dashboard indicator 68 and a top surface of the dashboard 50.

A nozzle adapter diffuser 84 is attachable to the air outlet nozzle end 18 of the tubular housing 14. A carry case 86 having a cover 88 with a hand grip 90 is hinged at 92 to a base 94, conveniently holds the portable hair dryer 12 when the handle 20 is in the inoperable position and other hair grooming equipment therein (see FIG. 1). The other hair grooming equipment can include a mirror 96, hairbrush 98 and hair spray container 100.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters patent is set forth in the appended claims:

1. A portable hair dryer comprising:

a) a tubular housing having an air inlet end and an air outlet nozzle end;

b) a foldable hollow pistol-type handle pivotally connected to said tubular housing adjacent said air inlet end, so that said handle can pivot from an inoperative position parallel to said tubular housing to an operative position perpendicular to said tubular housing;

c) an electrically actuated air pump assembly in said tubular housing to draw air in through said air inlet end and out through said air outlet nozzle end;

d) an electrical resistance heating element disposed within said tubular housing between said air pump assembly and said air outlet nozzle end, to heat the air passing through said tubular housing;

e) a circuit which electrically connects said air pump assembly and said heating element with a source of electrical power through said handle;

f) a handle positioning switch in said circuit between said tubular housing and said handle, so that when said handle pivots from the inoperative position to the operative position, said handle positioning switch will electrically close said circuit;

g) a male connector on distal free end of said handle, a power cord having a female connector on a first end to be inserted into said male connector, and a male adapter plus on a second end of said power cord to engage with a cigarette lighter receptacle in a dashboard of a motor vehicle that is electrically connected to a battery in the motor vehicle for a source of electrical power;

h) means for indicating the voltage state of said battery in said vehicle comprising a voltage measuring electrical circuit in said housing and a first display in said housing and a movable member having a wire connected independently to said male adapter plug and a second display showing voltage life left in terms of time remaining, said movable member having means for removably mounting said movable member on said dashboard of said vehicle so that the user of said hair dryer can ascertain battery voltage conditions from either said housing or said movable member, and said male adapter plug having a socket to receive a jack attached to the distal end of said wire connected to said movable member;

i) said first display including a first diode sensor to visually indicate a high voltage condition of said battery, a second diode sensor to visually indicate a medium voltage condition of the battery, a third diode sensor to visually indicate a low voltage condition of the battery, and an alarm connected to said third diode sensor to sound an audible signal when said third diode sensor indicates the low voltage condition of said battery.

2. A portable hair dryer as recited in claim 1, wherein said air pump assembly includes:

a) a two-speed (low and high) electric motor;

b) an air impeller driven by said motor; and c) a three position switch in said circuit, disposed on said handle and electrically connected to said motor to selectively actuate said motor at low speed, high speed and in an off position.

3. A portable hair dryer as recited in claim 1, further including a three position heat control switch in said circuit disposed on said handle and electrically connected to said heating element, to selectively control heat to said heating element at hot, warm and cool positions.

4. A portable hair dryer as recited in claim 1, further including a timer and low voltage shut off member in said circuit disposed on said handle, so as to time complete operation thereof.

5. A portable hair dryer as recited in claim 1, wherein said dashboard attaching means is a hook and loop VELCRO fastener secured between a bottom surface of said dashboard indicator and a top surface of the dashboard.

6. A portable hair dryer as recited in claim 1, further including a nozzle adapter diffuser attachable to said air outlet nozzle end of said tubular housing.

7. A portable hair dryer as recited in claim 1, further including a carry case having a cover with a hand grip hinged to a base, which conveniently holds said portable hair dryer when said handle is in the inoperable position and other hair grooming equipment therein.

* * * * *